US005446439A

United States Patent [19]

Kramer et al.

[11] Patent Number: 5,446,439

[45] Date of Patent: Aug. 29, 1995

[54] EMERGENCY CONDITION LIGHTING CONTROLLER

[75] Inventors: John C. Kramer, Kokomo; Robert O. Melvin, Lebanon, both of Ind.

[73] Assignee: Smartronics, Inc., Indianapolis, Ind.

[21] Appl. No.: 37,914

[22] Filed: Mar. 26, 1993

[51] Int. Cl.[6] ..... G08B 27/00

[52] U.S. Cl. ..... 340/326; 340/331; 340/332; 340/815.69; 315/129

[58] Field of Search ..... 340/326, 331, 332, 815.4, 340/815.46, 815.69; 315/129, 133, 200 A

[56] References Cited

U.S. PATENT DOCUMENTS

| | | | |
|---|---|---|---|
| 2,213,100 | 8/1940 | Cianchi | 340/110 A |
| 2,313,560 | 3/1943 | Levine | 340/815.69 |
| 3,054,994 | 9/1962 | Haram | 340/326 |
| 3,810,170 | 5/1974 | Zinsmeister | 340/521 |
| 4,203,091 | 5/1980 | Kruskopf | 340/331 |
| 4,276,542 | 6/1981 | Russ | 340/326 |
| 4,287,509 | 9/1981 | Beggs | 340/326 |
| 4,365,238 | 12/1982 | Kollin | 340/521 |
| 4,642,477 | 2/1987 | Grzanowski, Jr. et al. | 307/113 |
| 4,881,058 | 11/1989 | Berry, III | 340/326 |
| 4,967,177 | 10/1990 | Nguyen | 340/326 |
| 5,175,528 | 12/1992 | Choi et al. | 340/331 |

*Primary Examiner*—John K. Peng
*Assistant Examiner*—Edward Lefkowitz
*Attorney, Agent, or Firm*—Woodard, Emhardt, Naughton, Moriarty & McNett

[57] ABSTRACT

An emergency lighting controller includes a first circuit responsive to an alarm signal or warning signal. The first circuit accepts positive or negative polarity input signals and detects the presence or absence of a signal in order to produce an output signal clearing a monostable timer circuit. The monostable timer circuit produces a predetermined duration signal upon receiving an alarm signal. In accordance with the predetermined duration signal produced by the monostable timer circuit, an astable timer or oscillator circuit activates and deactivates an output control circuit in accordance with the frequency and duty cycle settings of the astable timer circuit. The output control circuit switches power on and off to a relay or a lighting circuit to provide a visual indicator of an emergency state that may require evacuation of the premises.

14 Claims, 2 Drawing Sheets

10

MONOSTABLE TIMER PERIOD SELECT
R10 ASTABLE TIMER CYCLE ADJUST
IC2 74HC74
IC3 556
IC1 M7805
VOLTAGE REGULATION AND REVERSE POLARITY PROTECTION
ALARM OUTPUT
ALARM INPUT AND RESET
ALARM OUT NC
ALARM OUT CMN
ALARM OUT NO
ALARM STATE NC
ALARM STATE CMN
ALARM STATE NO
ALARM IN +
ALARM IN -
V+
GND
+5V
12
14
14a
14b
16
18
20
20a

EMERGENCY CONDITION LIGHTING CONTROLLER

FIELD OF THE INVENTION

This invention relates to a visual warning system, and more specifically to a lighting system controller for use with an existing lighting system, such as are found in public facilities, to provide emergency condition warning signals to persons in the facility who may be in danger.

BACKGROUND OF THE INVENTION

Recent revisions in Federal law require owners of public facilities, such as retail establishments, install or upgrade existing lighting control systems to provide visual warning signals in the event of an emergency condition. Such visual warning signals are for the benefit of those who are hearing handicapped.

One known signaling system is disclosed in U.S. Pat. No. 4,287,509 to Beggs. The Beggs device provides both audible and visual signaling of emergency conditions. The audible signaling component of the system comprises a well-known audible fire alarm. The visual signaling component comprises a sensor for sensing the application of a signal to the audible warning device, and a circuit that activates a signaling lamp in response to electrical sensing of the audible warning signal.

Other known signaling/alarm/warning systems are disclosed in the following U.S. Pat Nos. 2,213,100 to Cianchi; 2,313,560 to Levine; 3,054,994 to Haram; 3,810,170 to Zinsmeister; 4,276,542 to Russ; 4,365,238 to Kollin; and 4,642,477 to Grzanowski, Jr. et al.

A light warning system that is easily integrated into an existing lighting system and which takes advantage of the existing lighting hardware to provide a visual warning signal is needed to modify previously installed electrical systems to comply with recently enacted laws relating to visual fire warning systems. A more economical and fully configurable light warning system or controller is needed that must be compatible with various existing fire/smoke sensing systems and provide an interface to control several types of lighting systems.

SUMMARY OF THE INVENTION

An emergency condition lighting controller, according to one aspect of the present invention, for use with a condition sensing system that produces a warning signal in response to detection of an unsafe condition, the emergency lighting controller interfacing with an existing lighting system that includes a plurality of power circuits and a plurality of lighting circuits, wherein each of the plurality of power circuits independently supplies a power signal to a corresponding one of the lighting circuits, the emergency condition lighting controller including first circuit means responsive to the emergency alarm signal, the first circuit means producing an alarm detected signal so long as the emergency alarm signal is present, second circuit means responsive to the alarm detected signal for producing a predetermined duration activation signal, third circuit means for producing an oscillating signal, the third circuit means responding to the predetermined duration activation signal to produce the oscillating signal so long as the predetermined duration activation signal is detected, and circuit interrupter means installed in series between certain ones of the power circuits and corresponding ones of the plurality of lighting circuits, the circuit interrupter means interrupting power to the lighting circuits in accordance with the frequency of the oscillating signal.

One object of the present invention is to provide an improved visual warning system.

Another object of the present invention is to provide a light warning system that is configurable for integration with existing lighting systems to provide a visual warning of emergency conditions.

Yet another object of the present invention is to provide a more economical solution in revising an existing lighting system to provide visual emergency signaling to occupants of a building that an emergency condition exists.

Still another object of the present invention is to provide a lighting system controller that enables the installer to select operational characteristics of the signaling system.

These and other objects of the present invention will become more apparent from the following description of the preferred embodiment.

DESCRIPTION OF THE PREFERRED EMBODIMENT

Figure 1:
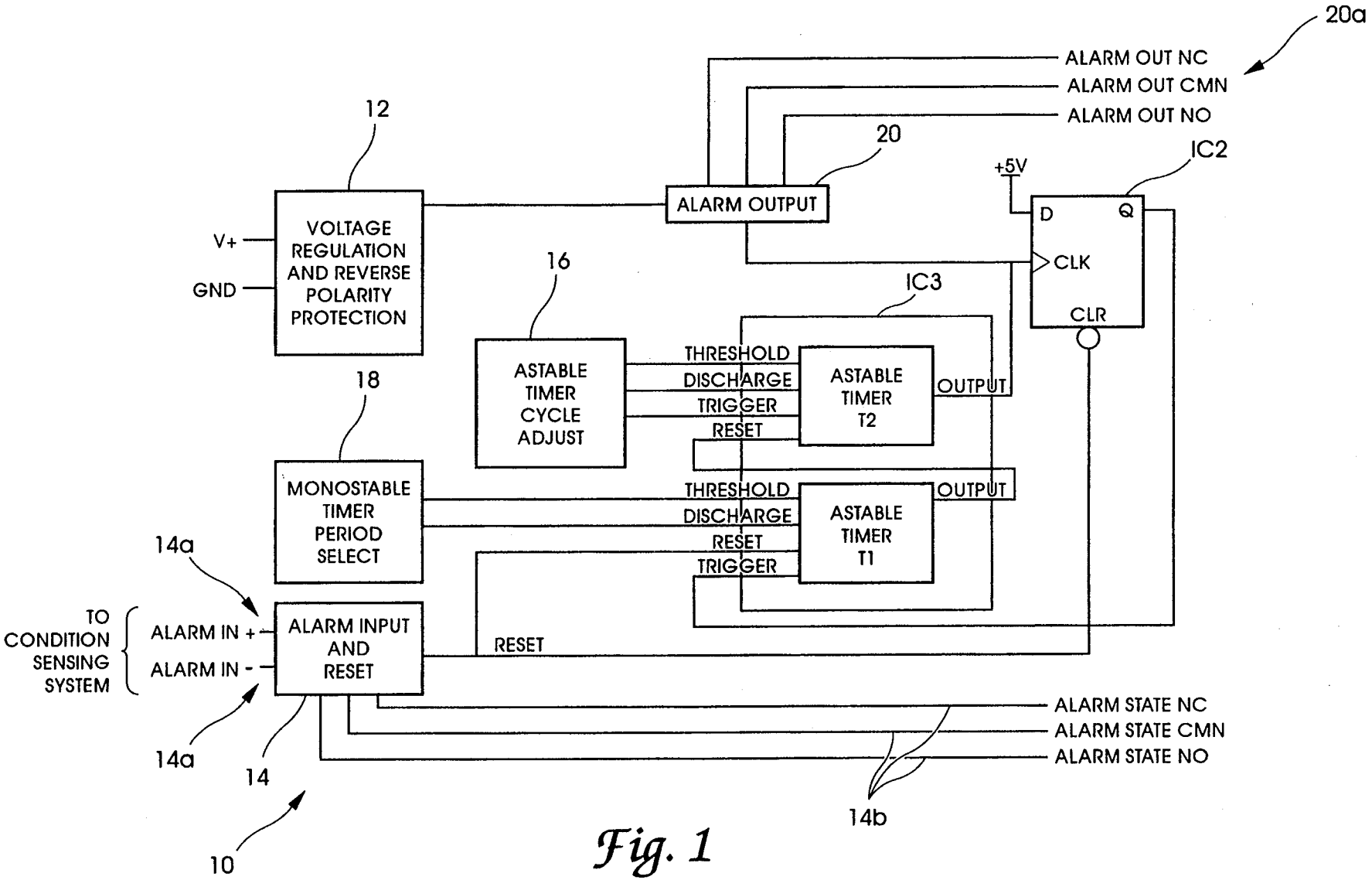
FIG. 1 is a block diagram of an emergency condition lighting controller according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, an emergency lighting controller 10 according to the present invention is shown. The controller 10 includes a voltage regulation and reverse polarity protection circuit 12, an alarm input and reset circuit 14, a monostable timer circuit T1, an astable timer circuit T2, an astable time cycle adjust circuit 16, a monostable timer period select circuit 18, a D-type flip-flop latch circuit IC2, and an alarm output device 20. Timer circuits T1 and T2 are contained within a single integrated circuit labeled IC3.

The inputs **14*a* of circuit 14, labelled ALARM IN+ and ALARM IN−, are connected to a condition sensing system or device (not shown). In the preferred embodiment, these inputs are connected to either normally open or normally closed dry contacts of a condition sensing device (not shown) such as a fire alarm system. The contacts of the condition sensing device must pass a signal suitable to energize relay K2 (in FIG. 2). The condition sensing system produces signals indicating fire or other emergency warning conditions exist and signals the controller 10 through the ALARM IN+ and ALARM IN− inputs. Input signals supplied to signal paths 14*a* are passed on to other devices that may require the warning signal. The input warning signal appears on output signal paths 14*b* labelled ALARM STATE NC, ALARM STATE CMN, and ALARM STATE NO. The output signals 14***b* are connections to a relay contact set (including a normally open contact, a normally closed contact and a common contact) contained within circuit 14 and shown in more detail if FIG. 2. The relay contacts are shorted or opened by the presence of a signal at input 14*a*. For example, the ALARM STATE NC and ALARM STATE CMN signals may be opened (or disconnected) in response to the presence of a signal at the input signal paths 14*a*. If the ALARM STATE NC contact and the ALARM STATE CMN contact are "shorted", then, the ALARM STATE CMN and ALARM STATE NO contact pair will be "open circuit". The relay contact set connected to the signals 14*b* operates in accordance with well known SPDT contact set principles. The three output signal paths provide flexibility in passing along or daisy-chaining additional devices or controllers should an alarm signal be required for these additional devices.

In the absence of an alarm signal at inputs 14*a*, the alarm circuit 14 provides a reset signal to timer circuit T1 and to the CLR input of latch circuit IC2. The output of circuit IC2 at the connection labelled Q is set to a logic low level and the reset input of the monostable timer T1 is set to a logic low level. Upon receiving an alarm signal at inputs 14*a*, the alarm circuit 14 provides an alarm signal to timer circuit T1. The timer circuit T1 produces a predetermined width pulse signal at its output in accordance with the components (resistors and capacitors) contained within circuit 18. The output signal from timer T1 is supplied to the RESET input of timer T2. Thus, when the output of timer T1 rises to a logic level high state, the astable timer T2 begins to oscillate in accordance with the timing components contained within circuit 16 that determine the oscillation frequency and duty cycle of the signal produced at the output of timer T2. The oscillating signal (typically a square wave signal) appearing at the output of timer T2 is supplied to the clock input of IC2 and to the alarm output circuit 20. The alarm output circuit 20 makes available three output signals at 20*a* labelled ALARM OUT NC, ALARM OUT CMN, and ALARM OUT NO. As is apparent from the labels, these signal paths are connections to a contact set of a relay (relay K1 in FIG. 2) contained within alarm output circuit 20. The relay is activated and deactivated in accordance with the output of astable timer T2.

Timer T2 supplies an oscillating signal to the alarm output circuit 20 for a time period determined by the presence of a logic high output signal at the output of timer T1. The output signal connections 20*a* are connected to a source of power and to the coil of a heavy duty relay used as a contactor for switching power, such as a FORM C relay used to control power supplied to lighting circuits (not shown). Such relay/power connections are well known and need no further discussion. AC power semiconductor devices are also contemplated as a "driver" for switching power to a coil of a power relay connected so as to supply or disconnect power to external lighting circuitry (not shown).

The voltage regulation and reverse polarity protection circuit 12 supplies DC regulated power to the various components of the controller 10 and protects against reverse polarity connections at the V+ and GND inputs of circuit 12. Typically, 24VDC or less is a desired power input signal.

Figure 2:
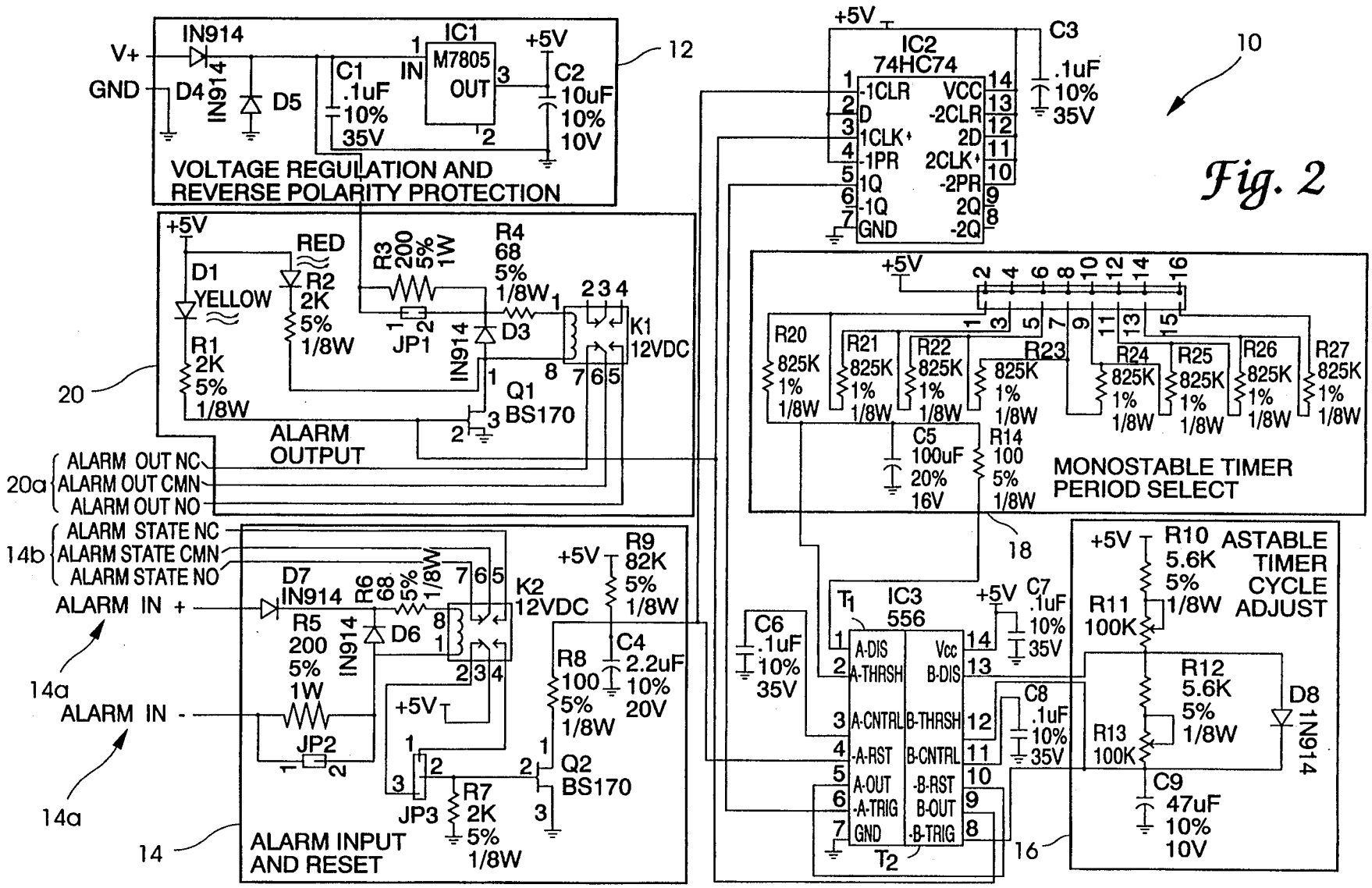
FIG. 2 is a schematic diagram of the emergency condition lighting controller of FIG. 1.

Referring now to FIG. 2, a more detailed schematic diagram of the lighting controller 10 according to the present invention is shown. Circuit 12 includes input protection diodes D4 and D5 to protect against reverse polarity connections at the power input connections V+ and GND. Circuit 12 also includes a 5 volt DC regulator IC1 that provides a 5 volt power signal to various locations noted throughout the schematic diagram of FIG. 1.

Circuit 14 includes diodes D7 and D6. Diode D6 provides a path for the dissipation of energy stored in relay K2. Diode D7 provides reverse polarity connection protection. Optionally, pins 1 and 2 of the jumper block JP2 may be shorted if the amplitude of the alarm input signal supplied at input 14*a* is a lower amplitude signal. Depending upon the polarity of the alarm input signal appearing at input 14*a*, the user may select between shorting pins 1 and 2 or shorting pins 2 and 3 at jumper block JP3. For example, if the presence of a signal at input 14*a* indicates an alarm condition or state, then pins 2 and 3 should be shorted so that upon the activation or energization of relay K2, a 5 volt signal is removed from the gate input of transistor Q2. Alternatively, if the absence of a signal at input 14*a* indicates an emergency state or alarm condition, then the user should jumper together pins 1 and 2 of jumper block JP3 so that the absence of a signal at input 14*a* results in the deactivation or removal of the 5 volt signal from the gate of transistor Q2.

Activation of transistor Q2 as an electronic switch, wherein the impedance of the device Q2 from the drain to the source is less than one ohm, results in a logic level low signal supplied to pin 4 of circuit IC3. Pin 4 of circuit IC3 is the reset input of timer T1. A high signal at pin 4 of IC3 initiates the cycling of the lighting system by the controller 10. The frequency and duty cycle of the output signal produced by astable timer T2 is controlled by potentiometers R11 and R13 of circuit 16 in combination with the value of capacitor C9. The component values for the resistors, capacitors and potentiometers shown enables adjustment of the flash rate of the device 10 from 0.5 to 2.8 seconds "on" and 0.5 to 2.8 seconds "off". Circuit IC3 is a well known dual-timer IC with the industry standard identification number "556".

In order to increase the warning period of time within which the lighting circuits (not shown) are switched on and off by the controller 10, the user should connect one of the 8 pairs of jumper connections appearing on jumper block JP4 in order to define the overall width of the pulse produced by the monostable timer circuit T1 of IC3. For example, jumpering pins 15 and 16 will connect a higher resistance value that includes the total of resistors R20–R27 with capacitor C5 to produce a longer time constant and thus a longer pulse output from monostable timer T1. The shortest duration output pulse from the monostable timer T1 is produced when pins 1 and 2 of jumper block JP4 are shorted together. The selected resistor and capacitor values shown for circuit 18 provide 1.5 minute increments of time so that the period of time the device 10 switches relay K1 on and off is variable from 1.5 minutes to 12 minutes. The minimum "flashing" time is selected by jumpering pins 1 and 2 of jumper block JP4. The maximum "flashing" time is selected by jumpering pins 15 and 16 of jumper block JP4.

The output signal from the astable timer T2 is supplied to the gate of transistor Q1, of circuit 20, and to the clock input of the latch circuit IC2. As the signal at the gate of transistor Q1 is toggled between a logic high and a logic low level, transistor Q1 is "turned on and off" and in an alternating fashion provides a path to ground for one lead of the coil of relay K1. Thus, relay K1 is energized and deenergized in accordance therewith. The contact set of relay K1, which is made available at 20*a* for connection to the coil of a heavy duty relay used as a contactor, includes a normally open and a normally closed contact set. Such connections are typical and well known in the art of relay power control and connections thereto.

Jumper block JP1 of circuit 20 enables the user to short out resistor R3 if the input voltage to circuit 12 appearing at the V+ input is 15 volts DC. Circuit 12 will also accept a 24 volt DC input. If 24 VDC is supplied to the input of circuit 12 at the V+ terminal, resistor R3 of circuit 20 should not be shorted out at jumper JP1 so that some voltage is dropped across resistor R3, and less voltage is dropped the coil of relay K1. Device IC1 is a 7805 voltage regulator, well known in the art of circuit design.

The resistor/capacitor combination of R9/C4 provides a low pass filter function for the signal that triggers the activation of the monostable timer T1. The filter prevents power-up activation of the monostable timer T1, thereby preventing undesired activation of the relay K1 (and undesired activation of the light flashing relay connected to the output signal paths 20*a*). Additional filtering functions can be implemented if the need arises to prevent false triggering or intermittent triggering of the device 10.

Certain components of the preferred embodiment may be replaced with other components well known in the art of electronics design. Specifically, BJT transistors may replace the FET transistors, relays K1 and K2 may be replaced with power semiconductor devices such as triacs or SCR devices, and the timer circuits T1 and T2 may be implemented by use of any of various timer integrated circuits, so long as the operational functionality of the circuitry remains intact. The functionality of the circuitry shown in FIG. 2 (or FIG. 1) can be implemented using a microprocessor based controller. Typically, a single-chip microcontroller is desired for such applications. In a microcontroller implementation, I/O ports would control relays and provide sensory input signal detection capability.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An emergency condition lighting controller for use with a condition sensing system that produces a warning signal in response to detection of an unsafe condition, said emergency lighting controller interfacing with an existing lighting system that includes a plurality of power circuits and a plurality of lighting circuits, wherein each of the plurality of power circuits independently supplies a power signal to a corresponding one of the lighting circuits, said emergency condition lighting controller comprising:

first circuit means responsive to said warning signal for producing an alarm detected signal so long as said warning signal is present;

second circuit means responsive to said alarm detected signal for producing a predetermined duration activation signal;

third circuit means for producing an oscillating signal at a predetermined frequency, said third circuit means responding to said predetermined duration activation signal to produce said oscillating signal so long as said predetermined duration activation signal is produced; and fourth circuit means responsive to said oscillating signal for supplying power switching signals at said oscillator frequency, said fourth circuit means interfacing with certain ones of said power circuits and corresponding ones of said plurality of lighting circuits to intermittently switch power from said power circuits to said lighting circuits in accordance with said power switching signals, to thereby cause the lighting circuits to flash on and off, only so long as said predetermined duration activation signal is present.

2. The device of claim 1 wherein said second circuit means includes user selectable jumper connections and wherein said predetermined duration activation signal is variable in duration in accordance with a user selectable connection configuration.

3. The device of claim 2 wherein said third circuit means includes frequency adjustment means for varying said predetermined frequency of said oscillating signal.

4. The device of claim 3 wherein said second circuit means is a monostable timer circuit.

5. The device of claim 4 wherein said third circuit means is an astable timer circuit.

6. The device of claim 5 wherein said first circuit means is responsive to positive and negative polarity warning signals from the condition sensing system, and wherein said first circuit means includes an initial power on circuit for delaying production of said alarm detected signal for a predetermined time period when power is initially supplied to said first circuit means.

7. The device of claim 6 wherein said user selectable jumper connections enable convenient connection in series of a plurality of passive circuit devices to vary a time constant of said monostable timer circuit.

8. An emergency lighting power control system for use with a condition sensing system that produces a warning signal in response to detection of an unsafe condition, said emergency lighting power control system interfacing with and controlling an existing lighting system that includes a plurality of power circuits and a plurality of lighting circuits, wherein each of the plurality of power circuits independently supplies a power signal to a corresponding one of the lighting circuits, said emergency condition lighting power control system comprising:

a first relay having a coil, a contact set having a normally open contact connection, a normally closed contact connection, and a common connection, and wherein said warning signal is supplied to said coil of said first relay and a power signal is supplied to said common connection;

isolation circuit means including an input and an output, said input of said isolation circuit connected to said normally open connection or said normally closed connection in accordance with a polarity of said warning signal, and wherein an isolated warning signal appears at said output of said isolation circuit when said coil of said first relay is energized;

a first time constant circuit including a resistor and a capacitor;

a monostable timer circuit having a monostable output, a monostable reset input, and a monostable time constant input, said monostable reset input connected to said output of said isolation circuit means, and said monostable time constant input connected to said first time constant circuit, and wherein said monostable timer produces an enable signal at said monostable output in response to said isolated warning signal appearing at said monostable reset input;

a second time constant circuit including a resistor and a capacitor;

an oscillator circuit means for producing an oscillating signal, said oscillator circuit means including an oscillator output, an oscillator time constant input connected to said second time constant circuit, and an enable input connected to said monostable output, wherein said oscillator circuit means produces said oscillating signal at a frequency defined by a time constant of said second time constant circuit in so long as said enable signal is supplied to said enable input; and an output circuit means responsive to said oscillator signal supplying power switching signals at said oscillator frequency, said fourth circuit means interfacing with selected ones of the plurality of power circuits and corresponding ones of said plurality of lighting circuits to intermittently switch power from said power circuits to said lighting circuits in accordance with said switching signals, to thereby cause the lighting circuits to flash on and off, only so long as said enable signal is supplied to said enable input.

9. The device of claim 8 wherein said isolation circuit means includes a low pass filter circuit, and wherein said low pass filter removes high frequency components from the signal supplied to said input of said isolation circuit and supplies a filtered signal to said output of said isolation circuit means.

10. The device of claim 9 wherein said first time constant circuit includes user selectable input means for altering a time constant of said first time constant circuit.

11. The device of claim 10 wherein said second time constant circuit includes user selectable input means for altering the time constant of said second time constant circuit.

12. The device of claim 11 wherein said output circuit means is a second relay having a coil energized in accordance with said oscillator signal, said second relay also including a plurality of contact sets connected in series between the power circuits and the lighting circuits.

13. The device of claim 12 including visual indicator means for producing a visual signal in response to said warning signal.

14. The device of claim 13 wherein said user selectable input means of said first and second time constant circuits are jumper connection blocks.

* * * * *